US011703896B2

(12) United States Patent
Tseng

(10) Patent No.: US 11,703,896 B2
(45) Date of Patent: Jul. 18, 2023

(54) LOW-DROPOUT REGULATOR AND CIRCUIT SYSTEM USING THE SAME

(71) Applicant: NUVOTON TECHNOLOGY CORPORATION, Hsinchu (TW)

(72) Inventor: Hua-Chun Tseng, Hsinchu (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 17/696,477

(22) Filed: Mar. 16, 2022

(65) Prior Publication Data

US 2023/0077930 A1 Mar. 16, 2023

(30) Foreign Application Priority Data

Sep. 13, 2021 (TW) ..... 110133959

(51) Int. Cl.
*G05F 1/46* (2006.01)

(52) U.S. Cl.
CPC ..... *G05F 1/461* (2013.01); *G05F 1/462* (2013.01); *G05F 1/468* (2013.01)

(58) Field of Classification Search
CPC ..... G05F 1/461; G05F 1/462; G05F 1/468
See application file for complete search history.

(56) References Cited

U.S. PATENT DOCUMENTS

2008/0224675 A1* 9/2008 Takagi ..... G05F 1/565 323/275
2009/0195227 A1* 8/2009 Morino ..... G05F 1/56 323/224
2014/0266105 A1* 9/2014 Li ..... G05F 1/565 323/280
2018/0307259 A1* 10/2018 Ogura ..... G05F 1/575
2020/0278713 A1* 9/2020 Hashemi ..... G06F 1/28

* cited by examiner

*Primary Examiner* — Jeffrey A Gblende
*Assistant Examiner* — Lakaisha Jackson
(74) *Attorney, Agent, or Firm* — Muncy, Geissler, Olds & Lowe, P.C.

(57) ABSTRACT

The present disclosure relates to a low-dropout regulator that limits a quiescent current. It mainly includes an error amplifier, an output switching transistor, a feedback switching transistor, a current duplicating circuit, and a clamping current source. The clamping current source is added between an input voltage and the feedback switching transistor, so that a feedback current outputted by the feedback switching transistor is clamped, and the highest value is only proportional to a current value of the clamping current source. In this way, the quiescent current outputted by the low-dropout regulator is no longer increasing indefinitely in proportional to a load current, which can effectively solve the technical problems of poor stability and decreased efficiency caused by the infinite increase of the quiescent current.

15 Claims, 2 Drawing Sheets

LOW-DROPOUT REGULATOR AND CIRCUIT SYSTEM USING THE SAME

CROSS-REFERENCE TO RELATED APPLICATION

This application claims the priority from the TW Patent Application No. 110133959, filed on Sep. 13, 2021.

BACKGROUND

1. Technical Field

The present disclosure relates to a low-dropout regulator, in particular to, a low-dropout regulator which can automatically limit a quiescent current when a load current is too high, and to a circuit system using the low-dropout regulator.

2. Description of the Related Art

To ensure the capabilities of load transient regulation, line transient regulation, and others and the stability under various loads all can meet certain requirements, a low-dropout regulator (LDO) therefore needs a higher quiescent current is required. Especially, the low-dropout regulator is to be designed with a larger output load capacity. The quiescent current is used for biasing components, so also known as a bias current.

TW Publication TW 201928566, "On chip NMOS capless LDO for high speed microcontrollers", disclosed a voltage regulator including an error amplifier configured to amplify a difference between a feedback voltage and a reference voltage. The voltage regulator also includes an N-type metal-oxide-semiconductor (NMOS) driver circuit. The driver circuit includes an N-type field-effect transistor. The driver circuit is electrically connected to an output terminal of the error amplifier. The voltage regulator further includes a feedback circuit electrically connected between the NMOS driver circuit and an input terminal of the error amplifier to provide a feedback loop of the feedback voltage.

In addition, TW Patent TWI537697, "Programmable low-dropout regulator and methods therefor", disclosed a low-dropout (LDO) regulator, which includes a voltage reference circuit, a pass device, and an error amplifier. The voltage reference circuit provides a reference voltage. The pass device includes an input terminal coupled to a voltage input, an output terminal to provide an output voltage, and a control terminal. The error amplifier includes a first amplifier input terminal for receiving the reference voltage, a second amplifier input terminal, an amplifier output terminal coupled to the control terminal of the pass device. Additionally, the LDO regulator includes a feedback circuit to provide a feedback signal. The feedback circuit includes an input terminal coupled to the output terminal of the pass device and a feedback output terminal coupled to the second amplifier input terminal. The LDO regulator also includes a control circuit, which includes a non-volatile memory to store configuration data to control the operation of the voltage reference circuit, the pass device, the error amplifier, and the feedback circuit to produce an output voltage.

The two prior arts mentioned above have their own advantages. However, as the relationship curve A shown in FIG. 2 represents the quiescent current versus the load current, there is a disadvantage, which is "the quiescent current will be indefinitely increasing in proportional to the load current so that the overall circuit has negative effects such as poor stability and decreased efficiency."

SUMMARY

The purpose of the present disclosure is to provide a low-dropout regulator and a circuit system using the low-dropout regulator, wherein the low-dropout regulator can automatically limit the quiescent current (i.e. the bias current) when the load current is too high, so as to improve the stability and efficiency of the overall circuit.

An embodiment of the present disclosure provides a low-dropout regulator. The low-dropout regulator with a load terminal for outputting an output voltage includes an error amplifier, an output switching transistor, a feedback switching transistor, a clamping current source, a bias current source, and a current duplicating circuit. A negative input terminal of the error amplifier is configured to receive a reference voltage, a non-negative input terminal of the error amplifier is electrically connected to the load terminal to receive the output voltage, and a positive bias terminal of the error amplifier is configured to receive an input voltage. A gate of the output switching transistor is electrically connected to an output terminal of the error amplifier, a source of the output switching transistor is configured to receive the input voltage, and a drain of the output switching transistor is electrically connected to the load terminal. The feedback switching transistor is controlled by a voltage of the output terminal of the error amplifier to generate a feedback current at a drain of the feedback switching transistor. A first terminal of the clamping current source is configured to receive the input voltage, and a second terminal of the clamping current source is electrically connected to a source of the feedback switching transistor. The bias current source is electrically connected to a negative bias terminal of the error amplifier and is configured to provide a first bias current to the error amplifier. An input terminal of the current duplicating circuit is electrically connected to the drain of the feedback switching transistor and configured to receive the feedback current, and an output terminal of the current duplicating circuit is electrically connected to the negative bias terminal of the error amplifier and configured to duplicate the feedback current to generate a second bias current to the error amplifier.

An embodiment of the present disclosure also provides a low-dropout regulator. The low-dropout regulator with a load terminal for outputting an output voltage includes an error amplifier, an output switch, a feedback switch, a clamping current source, a bias current source, and a current duplicating circuit. A first input terminal of the error amplifier is configured to receive a reference voltage, a second input terminal of the error amplifier is electrically connected to the load terminal to receive an output voltage, and a positive bias terminal of the error amplifier is configured to receive an input voltage. A controlled terminal of the output switch is electrically connected to an output terminal of the error amplifier, an input terminal of the output switch is configured to receive the input voltage, and an output terminal of the output switch is electrically connected to the load terminal. The feedback switch is controlled by a voltage of the output terminal of the error amplifier to generate a feedback current at an output terminal of the feedback switch. A first terminal of the clamping current source is configured to receive the input voltage, and a second terminal of the clamping current source is electrically connected to an input terminal of the feedback switch. The bias current source is electrically connected to a negative bias terminal of the error amplifier and configured to provide a first bias current to the error amplifier. An input terminal of the current duplicating circuit is electrically connected to the output terminal of the feedback switch and configured to receive the feedback current, and an output terminal of the current duplicating circuit is electrically connected to the negative bias terminal of the error amplifier and configured to duplicate the feedback current to generate a second bias current to the error amplifier. When a load current at the load terminal reaches a predetermined value, the feedback switch is completely turned on, and a current value of the feedback current is equal to a current value of the clamping current source. Moreover, when a load current at the load terminal does not reach the predetermined value, the feedback switch is partially turned on, and the feedback current is proportional to the load current.

An embodiment of the present disclosure also provides a circuit system, which includes one of the low-dropout regulators mentioned above, and a load circuit which is electrically connected to the load terminal.

In summary, compared with the prior art, in the present disclosure, a current source is set between the feedback switching transistor and the input voltage, so that the feedback current outputted by the feedback switching transistor is limited. Therefore, the maximum value of the feedback current is as same as the value of the current source. As a result, the quiescent current of the error amplifier of the low-dropout regulator is also limited to prevent the problem of the quiescent current increasing indefinitely with the load current. On the other hand, when the load current is low, the feedback current outputted by the feedback switching transistor is still proportional to the load current, which can meet the characteristic requirements of the low-dropout regulator.

To further understand the technology, means, and effects of the present disclosure, reference may be made by the detailed description and drawing as follows. Accordingly, the purposes, features and concepts of the present disclosure can be thoroughly and concretely understood. However, the following detail description and drawings are only used to reference and illustrate the implementation of the present disclosure, and they are not used to limit the present disclosure.

BRIEF DESCRIPTION OF THE DRAWINGS

The drawings are provided to make the persons with ordinary knowledge in the field of the art further understand the present disclosure, and are incorporated into and constitute a part of the specification of the present disclosure. The drawings illustrate demonstrated embodiments of the present disclosure, and are used to explain the principal of the present disclosure together with the description of the present disclosure.

DESCRIPTION OF THE PREFERRED EMBODIMENTS

Figure 1:
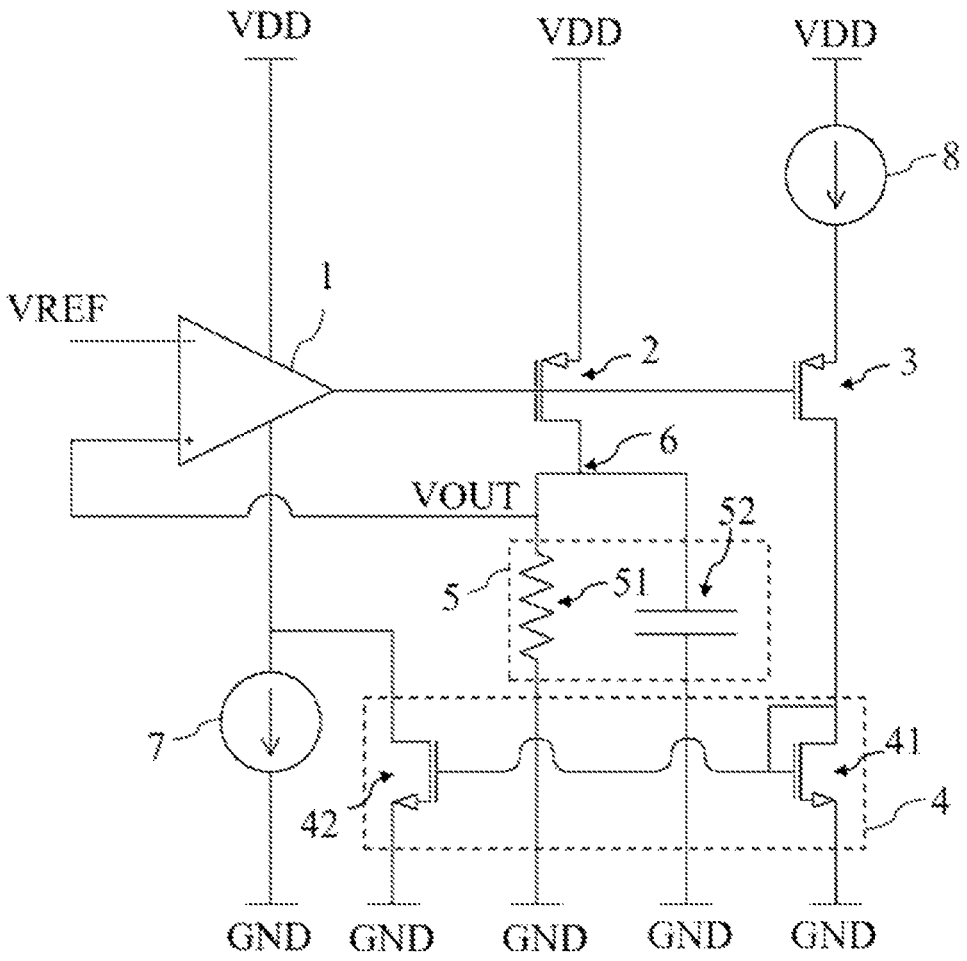
FIG. 1 is a circuit diagram of a low-dropout regulator in a circuit system according to an embodiment of the present disclosure.

The embodiments of the present disclosure are described in detail as reference, and the drawings of the present disclosure are illustrated. In the case of possibility, the element symbols are used in the drawings to refer to the same or similar components. In addition, the embodiment is only one approach of the implementation of the design concept of the present disclosure, and the following multiple embodiments are not intended to limit the present disclosure.

For a general low-dropout regulator which generates a feedback current according to load current, if the load current is getting higher, the quiescent current (i.e. the bias current) will increase indefinitely with the increasing of the load current, which will decrease stability and efficiency of the overall circuit. At the same time, it also causes unnecessary loss of electrical energy. In order to solve the problem, an embodiment of the present disclosure provides a low-dropout regulator that can automatically limit the quiescent current. The main feature of the low-dropout regulator of the present disclosure is that a clamping current source is added between a feedback switching transistor and an output voltage. Therefore, when the load current reaches a predetermined value, the feedback switching transistor is completely turned on to clamps the load current only to be the maximum value, wherein the maximum value of the feedback current is proportional to the current value of the clamping current source. In this way, the quiescent current will not increase indefinitely with the increasing of load current, and the technical problems of the poor circuit stability and efficiency due to the indefinite increasing of the quiescent current can be solved. Additionally, when the load current is lower than the predetermined value, the feedback switching transistor is partially turned on, so that the feedback current is 1/K times the load current, to meet the characteristic requirements of the low-dropout regulator, wherein K is greater than or equal to 1. The above descriptions are the design concepts of the low-dropout regulator of the present disclosure, and the further details will be described as follows in conjunction with the drawings.

Referring to FIG. 1, which is a circuit diagram of a low-dropout regulator in a circuit system according to an embodiment of the present disclosure. The circuit system includes a low-dropout regulator and a load circuit 5. The low-dropout regulator includes an error amplifier 1, an output switching transistor 2, a feedback switching transistor 3, a current duplicating circuit 4, a bias current source 7, and a clamping current source 8. The low-dropout regulator receives an input voltage VDD and a reference voltage VREF, and reduces the input voltage VDD to generate an output voltage VOUT at a load terminal 6 of the low-dropout regulator to the load circuit 5. The input voltage VDD can be a system voltage or a voltage generated by the system voltage, and the present disclosure is not limited thereto.

The low-dropout regulator will compare the reference voltage VREF and the output voltage VOUT to control the output voltage VOUT to be lower than the input voltage VDD. In addition, when the load current is lower (the load current does not reach a predetermined value), the quiescent current generated by the low-dropout regulator to the error amplifier 1 via a feedback loop is proportional to the load current. Usually, the quiescent current is designed to be 1/K times the load current, wherein K is greater than or equal to 1. Furthermore, when the load current is higher (i.e. the load current reaches the predetermined value), the quiescent current generated by the low-dropout regulator to the error amplifier 1 via the feedback loop is proportional to the current value of the clamping current source. For example, the quiescent current generated to the error amplifier 1 is equal to the current value of the clamping current source.

In this embodiment, the load circuit 5 can be any type of load circuit. For example, various analog or digital circuits which require a voltage lower than the system voltage as the supply voltage. The load circuit 5 can be equivalent to a resistor 51 and a load capacitor 52, both of which are connected in parallel with each other. Although the load circuit 5 of FIG. 1 is equivalent to the load resistor 51 and the load capacitor 52, both of which are connected in parallel with each other, the present disclosure is not limited thereto. In other embodiments, the load circuit 5 can be equivalent to other types of circuit, such as a RLC (resistor, inductor and capacitor) circuit. Preferably, the circuit system can be integrated into a chip. Alternatively, the low-dropout regulator is implemented in one chip, and the load circuit 5 is implemented in another chip.

Then, the details of the low-dropout regulator are further described. A negative input terminal of the error amplifier 1 is electrically connected to the reference voltage VREF, and a non-negative input terminal of the error amplifier 1 is electrically connected to the load terminal 6 to receive the output voltage VOUT. An output terminal of the error amplifier 1 is electrically connected to a gate of output switching transistor 2. A positive bias terminal of the error amplifier 1 receives the input voltage VDD, and a negative bias terminal of the error amplifier 1 is electrically connected to the bias current source 7 and an output terminal of the current duplicating circuit 4. Moreover, the bias current source 7 is configured to provide a first bias current (i.e. the quiescent current provided by the bias current source 7) to the error amplifier 1.

The output switching transistor 2 is served as a power device for the low-dropout regulator. Moreover, a source of the output switching transistor 2 is configured to receive the input voltage VDD, and a drain of the output switching transistor 2 is served as the load terminal 6. Thus, the output switching transistor 2 reduces the input voltage VDD to generate the output voltage VOUT at the load terminal 6. According to an impedance of the load terminal 6, the output voltage VOUT is configured to generate a load current flowing through the load terminal 6. The load circuit 5 is electrically connected between the load terminal 6 and a ground voltage GND (or a low voltage lower than the input voltage VDD). Moreover, two terminals of each of the load resistor 51 of the load circuit 5 are respectively electrically connected to the load terminal 6 and the ground voltage GND. The output switching transistor 2 is preferably a P-type metal-oxide-semiconductor field-effect transistor (MOFET), but the present disclosure is not limited thereto.

A gate of the feedback switching transistor 3 is electrically connected to the output terminal of the error amplifier 1. A first terminal of the clamping current source 8 is configured to receive the input voltage VDD, while a second terminal of the clamping current source 8 is electrically connected to a source of the feedback switching transistor 3. In other words, the clamping current source 8 is electrically connected between the feedback switching transistor 3 and the input voltage VDD. Furthermore, a drain of the feedback switching transistor 3 is electrically connected to the input terminal of the current duplicating circuit 4. The feedback switching transistor 3 is controlled by the voltage at the output terminal of the error amplifier 1 to generate the feedback current. When the load current is lower, the feedback switching transistor 3 is partially turned on, and the generated feedback current is 1/K times the load current flowing through the output switching transistor 2. Additionally, K is greater or equal to 1, and K is related to the ratio between the ratio of the channel width over area of the output switching transistor 2 and the ratio of the channel width over area of the feedback switching transistor 3. When the load current is getting higher to reach the predetermined value, the feedback switching transistor 3 is completely turned on. As a result, the current value of the feedback current generated by the feedback switching transistor 3 is equal or proportional to the current value of the clamping current source 8.

The current duplicating circuit 4 is configured to duplicate the feedback current received at the input terminal of the current duplicating circuit 4 to the output terminal of the current duplicating circuit 4 to generate a second bias current (i.e. the quiescent current provided by the output terminal of the current duplicating circuit 4) to the negative bias terminal of the error amplifier 1, so that the bias current at the negative bias terminal of the error amplifier 1 is the first bias current source provided by the bias current source 7 plus the second bias current provided by the output terminal of the current duplicating circuit 4. Generally speaking, the current duplicating circuit 4 includes a first switching transistor 41 and a second switching transistor 42. Preferably, the first switching transistor 41 and the second switching transistor 42 are N-type MOSFETs, and the present disclosure is not limited thereto.

A drain of the first switching transistor 41 is electrically connected to the drain of the feedback switching transistor 3. Also, the drain of the first switching transistor 41 is electrically connected to a gate of the first switching transistor 41, and a source of the first switching transistor 41 is electrically connected to the ground voltage, or a low voltage lower than the input voltage VDD. The gate of the first switching transistor 41 is electrically connected to a gate of the second switching transistor 42. Besides, a drain of the second switching transistor 42 is electrically connected to the negative bias terminal of the error amplifier 1, and a source of the second switching transistor 42 is electrically connected to the ground voltage, or a low voltage lower than the input voltage VDD.

Furthermore, the ratio of channel width over area of the first switching transistor 41 can be equal to the ratio of channel width over area of the first switching transistor 41, so that the second bias current generated by the output terminal of the current duplicating circuit 4 is equal to the feedback current received at the input terminal of the current duplicating circuit 4. Certainly, in other embodiments, the ratio of channel width over area of the first switching transistor 41 and the ratio of channel width over area of the second switching transistor 42 may be different from each other, so that the second bias current is proportional to the feedback current received at the input terminal of the current duplicating circuit 4. To further explain, the embodiment of the current duplicating circuit 4 described above is only one of the implementation manners of the present disclosure, and the implementation manner of the current duplicating circuit 4 is not to limit the present disclosure.

In this way, with the incorporation of the feedback switching transistor 3, the clamping current source 8, and the output switching transistor 2, the feedback switching transistor 3 is served as a voltage controlled switch to regulate the feedback current output by the feedback switching transistor 3. In addition, when the feedback switching transistor 3 is completely turned on, the output maximum current value is the current value of the feedback current of the clamping current source 8 to limit the quiescent current generated to the error amplifier 1. Moreover, the quiescent current changed with the load current can be configured to regulate the pole and zero compensation of the low-dropout regulator, so the present disclosure can be carried out without the requirements of the compensated circuit Additionally speaking, the above-mentioned the output switching transistor 2 can be replaced by other types of output switches, wherein the gate of the output switching transistor 2 is served as a controlled terminal of the output switch, the source of the output switching transistor 2 is served as the input terminal of the output switch, and the drain served as the output terminal of the output switch. Similarly, the above-mentioned feedback switching transistor 3 can be replaced by other types of feedback switches, wherein the gate of the feedback switching transistor 3 served as the controlled terminal of the feedback switch, the source of the feedback switching transistor 3 served as the input terminal of the feedback switch, and the drain of the feedback switching transistor 3 served as the output terminal of the feedback switch. On the top of that, in other cases, the negative input terminal and non-negative input terminal of the error amplifier 1 may be changed to receive the output voltage VOUT and the reference voltage VREF respectively, and correspondingly, a feedback switch and an output switch will adopt the different types of the transistors.

Figure 2:
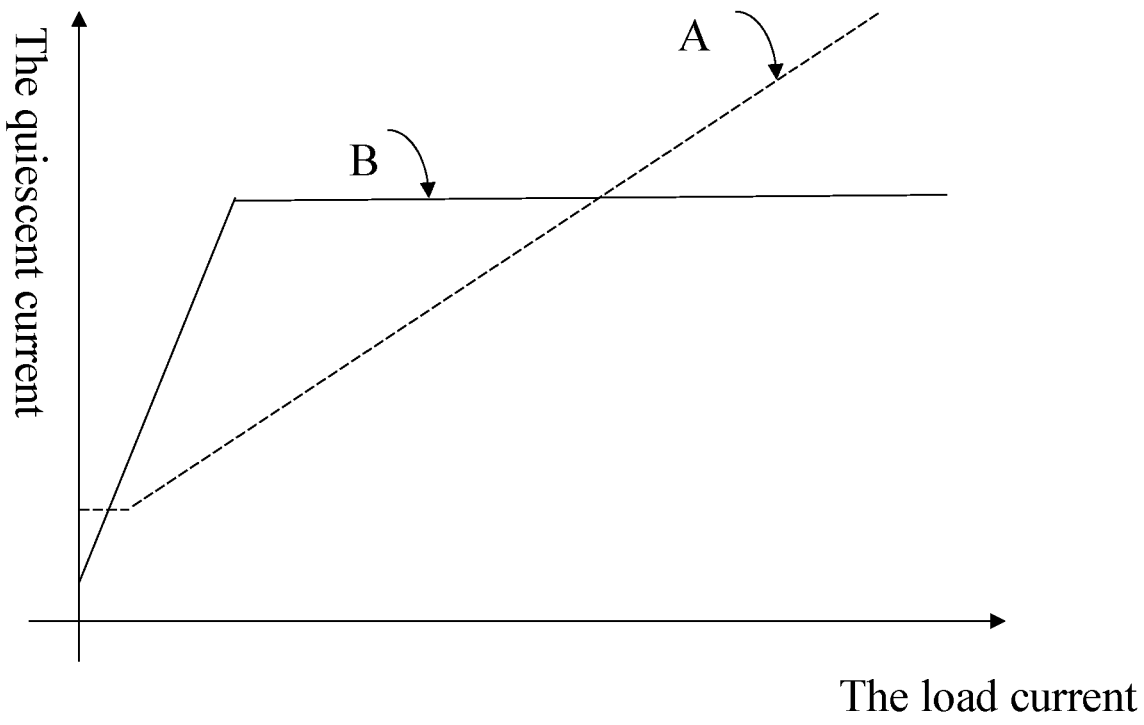
FIG. 2 is a curve diagram showing the relationships that represents quiescent current values versus load current values of both low-dropout regulators of the present disclosure and the prior art.

Referring to FIG. 1 and FIG. 2 at the same time, FIG. 2 is a curve diagram showing the relationships that represents quiescent current values versus load current values of both low-dropout regulators of the present disclosure and the prior art. As shown in the relationship curve B, when the load current is very low, the feedback switching transistor 3 is partially turned on, and the feedback current outputted by the feedback switching transistor 3 is proportional to the load current. When the load current continuously rise to make the feedback switching transistor 3 be completely turned on, the current value of the feedback current outputted by the feedback switching transistor 3 is equal or proportional to the current value of the clamping current source 8. As a result, the quiescent current outputted by the low-dropout regulator will not increase indefinitely with the load current. Additionally, it is worth to mention that when the current value of the feedback current is lower than the current value of the clamping current source 8 (i.e. the feedback switching transistor 3 is partially turned on), the value of the feedback current can be substantially thousandth of the load current, which means the aforementioned K is 1000. Further, the proportional relationship between the feedback current and the load current can be designed according to the actual requirements. Compared with the relationship curve A of the prior art, the relationship curve B shows the low-dropout regulator of the present disclosure can reduce more unnecessary power loss and increase the stability of the low-dropout regulator.

As described above, one of the main features of the present disclosure is to add the clamping current source 8 between the input voltage VDD and the feedback switching transistor 3, which makes the overall quiescent current not increase indefinitely. Instead, as shown by the relationship curve B of the quiescent current versus the load current shown in FIG. 2, the quiescent current increases in proportional to the load current at the beginning. While the quiescent current increases at the predetermined value, the feedback switching transistor 3 is completely turned on, and the feedback current reaches to the maximum value, which is limited by the clamping current source 8. Therefore, when the quiescent reached the maximum value, it cannot increase any more.

Consequently, the present disclosure has the advantages as follows. Firstly, the design of the overall circuit is simplified, and no additional complicated circuit design is required, wherein the clamping current source 8 is added between the input voltage VDD and the feedback switching transistor 3 so that the purpose of limiting the quiescent current can be achieved. Secondly, only the very low quiescent current value is required when the load current is extremely low or no load current, which reduces the requirements and limitations of the minimum load current value of the common low-dropout regulator with large load capacity. Thirdly, the adaptive biasing technology is used, and therefore, the quiescent current value of the low-dropout regulator will not increase significantly when the low-dropout regulator is operated at the maximum load current value. Fourthly, the feature of the quiescent current changing with load current is used to regulate the pole and zero compensation of the low-dropout regulator, which realizes the feature that no additional compensation circuit is required.

It should be understood that the examples and embodiments described herein are for illustrative purpose only, and various modification or change in view of them will be suggested to those skilled in the art, and will be included in the spirit and scope of this application and the appendix within the scope of the claims.

What is claimed is:

1. A low-dropout regulator with a load terminal for outputting an output voltage, comprising:

an error amplifier, having a negative input terminal configured to receive a reference voltage, a non-negative input terminal electrically connected to the load terminal to receive the output voltage, and a positive bias terminal configured to receive an input voltage;

an output switching transistor, having a gate electrically connected to an output terminal of the error amplifier, a source configured to receive the input voltage, and a drain electrically connected to the load terminal;

a feedback switching transistor, being controlled by a voltage of the output terminal of the error amplifier to generate a feedback current at a drain thereof;

a clamping current source, having a first terminal configured to receive the input voltage, and a second terminal electrically connected to a source of the feedback switching transistor;

a bias current source, electrically connected to a negative bias terminal of the error amplifier and configured to provide a first bias current to the error amplifier; and a current duplicating circuit, having an input terminal electrically connected to the drain of the feedback switching transistor and configured to receive the feedback current, and an output terminal electrically connected to the negative bias terminal of the error amplifier and configured to duplicate the feedback current to generate a second bias current to the error amplifier.

2. The low-dropout regulator according to claim 1, wherein when a load current at the load terminal reaches a predetermined value, the feedback switching transistor is completely turned on, and a current value of the feedback current is equal to a current value of the clamping current source.

3. The low-dropout regulator according to claim 2, wherein when the load current at the load terminal does not reach the predetermined value, the feedback switching transistor is partially turned on, and the feedback current is proportional to the load current.

4. The low-dropout regulator according to claim 3, wherein when the load current at the load terminal does not reach the predetermined value, the ratio of the feedback current and the load current is thousandth.

5. The low-dropout regulator according to claim 1, wherein the current duplicating circuit further comprises:

a first switching transistor, having a drain serving as the input terminal of the current duplicating circuit, a source electrically connected to a low voltage, and a gate electrically connected to the drain thereof; and a second switching transistor, having a gate electrically connected to the gate of the first switching transistor, a drain serving as the output terminal of the current duplicating circuit, and a source electrically connected to the low voltage.

6. The low-dropout regulator according to claim 5, wherein each of the first switching transistor and the second switching transistor is an N-type metal-oxide-semiconductor field-effect transistor (MOFET).

7. A low-dropout regulator with a load terminal for outputting an output voltage, comprising:

an error amplifier, having a first input terminal configured to receive a reference voltage, a second input terminal electrically connected to the load terminal to receive an output voltage, and a positive bias terminal configured to receive an input voltage;

an output switch, having a controlled terminal electrically connected to an output terminal of the error amplifier, an input terminal configured to receive the input voltage, and an output terminal electrically connected to the load terminal;

a feedback switch, being controlled by a voltage of the output terminal of the error amplifier to generate a feedback current at an output terminal thereof;

a clamping current source, having a first terminal configured to receive the input voltage, and a second terminal electrically connected to an input terminal of the feedback switch;

a bias current source, electrically connected to a negative bias terminal of the error amplifier and configured to provide a first bias current to the error amplifier; and a current duplicating circuit, having an input terminal electrically connected to the output terminal of the feedback switch and configured to receive the feedback current, and an output terminal electrically connected to the negative bias terminal of the error amplifier and configured to duplicate the feedback current to generate a second bias current to the error amplifier;

wherein, when a load current at the load terminal reaches a predetermined value, the feedback switch is completely turned on, and a current value of the feedback current is equal to a current value of the clamping current source; and when a load current at the load terminal does not reach the predetermined value, the feedback switch will be partially turned on, and the feedback current is proportional to the load current.

8. The low-dropout regulator according to claim 7, wherein the first input terminal and the second input terminal of the error amplifier are respectively a negative input terminal and a non-negative input terminal, and each of the output switching transistor and the feedback switching transistor is a P-type MOSFET.

9. The low-dropout regulator according to claim 7, wherein the current duplicating circuit is comprising:

a first switching transistor, having a drain serving as the input terminal of the current duplicated circuit, a source electrically connected to a low voltage, and a gate electrically connected to the drain thereof; and a second switching transistor, having a gate electrically connected to the gate of the first switching transistor, a drain serving as the output terminal of the current duplicating circuit, and a source electrically connected to the low voltage.

10. A circuit system, which is comprising:

a low-dropout regulator with a load terminal for outputting an output voltage, comprising:

an error amplifier, having a negative input terminal configured to receive a reference voltage, an non-negative input terminal electrically connected to the load terminal and configured to receive the output voltage, and a positive bias terminal configured to receive an input voltage;

an output switching transistor, having a gate electrically connected to an output terminal of the error amplifier, a source configured to receive the input voltage, and a drain electrically connected to the load terminal;

a feedback switching transistor, being controlled by a voltage of the output terminal of the error amplifier to generate a feedback current at a drain thereof;

a clamping current source, having a first terminal configured to receive the input voltage, and a second terminal electrically connected to a source of the feedback switching transistor;

a bias current source, electrically connected to a negative bias terminal of the error amplifier and configured to provide a first bias current to the error amplifier;

a current duplicating circuit, having an input terminal electrically connected to the drain of the feedback switching transistor for receiving the feedback current, and an output terminal electrically connected to the negative bias terminal of the error amplifier and configured to duplicate the feedback current to generate a second bias current to the error amplifier; and a load circuit, electrically connected to the load terminal.

11. The circuit system according to claim 10, wherein when a load current at the load terminal reaches a predetermined value, the feedback switching transistor is completely turned on, and a current value of the feedback current is equal to a current value of the clamping current source.

12. The circuit system according to claim 11, wherein when the load current at the load terminal does not reach the predetermined value, the feedback switching transistor is partially turned on, and the feedback current is proportional to the load current.

13. The circuit system according to claim 12, wherein when the load current at the load terminal does not reach the predetermined value, the ratio of the feedback current and the load current is thousandth.

14. The circuit system according to claim 10, wherein the current duplicating circuit further comprises:

a first switching transistor, having a drain serving as the input terminal of the current duplicating circuit, a source electrically connected to a low voltage, and a gate electrically connected to the drain thereof; and a second switching transistor, having a gate electrically connected to the gate of the first switching transistor, a drain serving as the output terminal of the current duplicating circuit, and a source electrically connected to the low voltage.

15. The circuit system according to claim 14, wherein each of the first switching transistor and the second switching transistor is an N-type metal-oxide-semiconductor field-effect transistor (MOFET).

* * * * *